US011297965B2

(12) United States Patent
Kenney et al.

(10) Patent No.: US 11,297,965 B2
(45) Date of Patent: Apr. 12, 2022

(54) CUPPED HOOK BRACKET CURTAIN ROD ASSEMBLY

(71) Applicant: Kenney Manufacturing Company, Warwick, RI (US)

(72) Inventors: Les Kenney, Warwick, RI (US); Scott Violette, Richmond, RI (US)

(73) Assignee: Kenney Manufacturing Company, Warwick, RI (US)

( * ) Notice: Subject to any disclaimer, the term of this patent is extended or adjusted under 35 U.S.C. 154(b) by 0 days.

(21) Appl. No.: 17/148,184

(22) Filed: Jan. 13, 2021

(65) Prior Publication Data

US 2021/0298511 A1 Sep. 30, 2021

Related U.S. Application Data

(60) Provisional application No. 63/000,262, filed on Mar. 26, 2020.

(51) Int. Cl.

| | |
|---|---|
| ***A47H 1/00*** | (2006.01) |
| ***A47H 1/142*** | (2006.01) |
| ***A47H 1/022*** | (2006.01) |

(52) U.S. Cl.

CPC ..... *A47H 1/142* (2013.01); *A47H 1/022* (2013.01)

(58) Field of Classification Search

None

See application file for complete search history.

(56) References Cited

U.S. PATENT DOCUMENTS

| | | | | |
|---|---|---|---|---|
| 4,405,108 | A * | 9/1983 | Muirhead | A47F 5/0823 211/70.6 |
| 6,845,955 | B1 * | 1/2005 | Hsu | A47K 3/38 211/123 |
| 9,271,593 | B1 * | 3/2016 | Chang | A47H 1/022 |
| 10,702,086 | B1 * | 7/2020 | Sayed | A47H 1/142 |
| 11,058,245 | B2 * | 7/2021 | Wright | A47G 25/0692 |
| 2011/0113547 | A1 * | 5/2011 | O'Connell | A47K 3/38 4/608 |
| 2015/0096117 | A1 * | 4/2015 | Forrest | A47H 1/022 4/610 |

* cited by examiner

*Primary Examiner* — Steven M Marsh

(74) *Attorney, Agent, or Firm* — Adler Pollock & Sheehan P.C.

(57) ABSTRACT

A cupped hook bracket includes a back wall having a central aperture, a cup, the cup having a semi-circular shape and projecting out from the back wall, a hook and a peg, the hook and the peg positioned centrally within the cup, and a stop and a ramp extending from the back wall and into a lower region of the cup.

11 Claims, 3 Drawing Sheets

CUPPED HOOK BRACKET CURTAIN ROD ASSEMBLY

CROSS REFERENCE TO RELATED APPLICATIONS

This application claims benefit from U.S. Provisional Patent Application Ser. No. 63/000,262 filed Mar. 26, 2020, which is incorporated by reference in its entirety.

BACKGROUND OF THE INVENTION

The present invention generally relates to curtain rod brackets, and more specifically to a cupped hook bracket curtain rod assembly.

In general, installation of traditional curtain rod brackets for securing curtain rods positioned by windows that are close to wall corners present unique challenges. Previous systems require placing a bracket away from a perpendicular wall that will otherwise interfere with curtain travel and not use one provided finial leaving, an unfinished aesthetic. Other previous systems require a plethora of brackets and adjustable angle tube connectors to accomplish the task of hanging curtain rods in tight spots.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In an aspect, the invention features a cupped hook bracket including a back wall having a central aperture, a cup, the cup having a semi-circular shape and projecting out from the back wall, a hook and a peg, the hook and the peg positioned centrally within the cup, and a stop and a ramp extending from the back wall and into a lower region of the cup.

In another aspect, the invention features an assembly including a telescoping tube, a first end of the telescoping tube including a channel, a cupped hooked bracket, the cupped hook bracket configured to engage the channel, a curtain rod bracket, the curtain rod bracket configured to engage a second end of the telescoping tube, the cupped hooked bracket including a back wall having a central aperture, a cup, the cup having a semi-circular shape and projecting out from the back wall, a hook and a peg, the hook and the peg positioned centrally within the cup, and a stop and a ramp extending from the back wall and into a lower region of the cup.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

The invention will be more fully understood by reference to the detailed description, in conjunction with the following figures, wherein.

DETAILED DESCRIPTION

Figure 1:
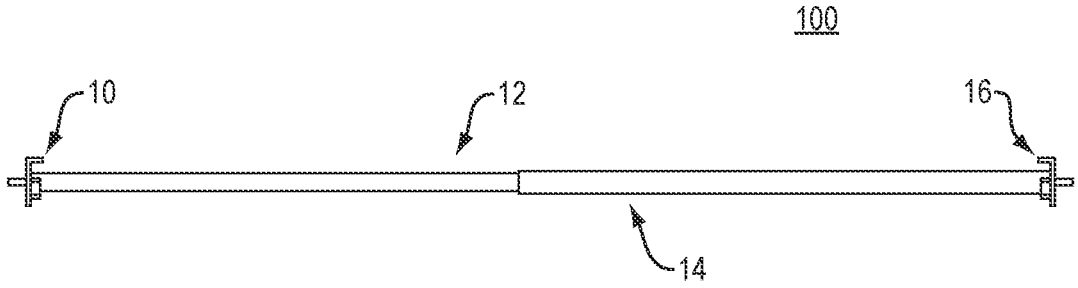
FIG. 1 illustrates an exemplary curtain rod assembly.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

As shown in FIG. 1, an exemplary curtain rod assembly 100 includes a first cupped bracket with hook 10, an inside curtain rod tube 12, and outside curtain rod tube 14 and a second cupped bracket with hook 16. When the first cupped bracket with hook 10 and the second cupped bracket with hook 16 are affixed to structures, the joined inside curtain rod tube 12 and outside curtain rod tube 14 may be secured to respective cupped bracket 10, 16.

While the embodiment shown in FIG. 1 includes a two part sliding curtain rod having the inside curtain rod tube 12 and the outside curtain rod tube 14, other embodiments may include a fixed length curtain rod.

Figure 2:
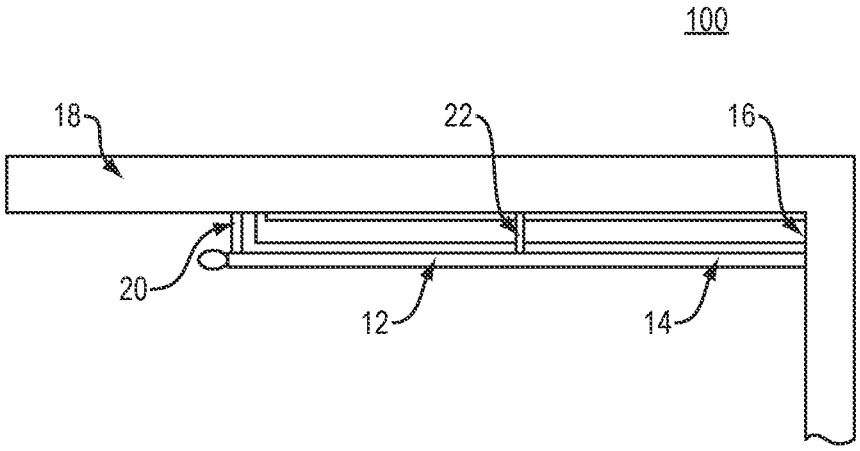
FIG. 2 illustrates a top view of the exemplary curtain rod assembly.

In FIG. 2, a top view of the exemplary curtain rod assembly 100 affixed to a wall structure 18 is illustrated. Here, the inside curtain rod tube 12 is shown secured to a long open portion of the structure 18 with a standard curtain rod bracket 20 while the outside curtain rod tube 14 is shown secured near a tight corner portion of the wall structure 18 with the cupped bracket with hook 16. In addition, in this embodiment, the rods 12, 14 are also supported by a center support 22. The cupped bracket with hook 16 provides a means of securing a curtain rod 12, 14 by a corner or a window that is close to a corner in a wall or other location that would otherwise prevent installation using traditional curtain rod brackets.

Figure 3:
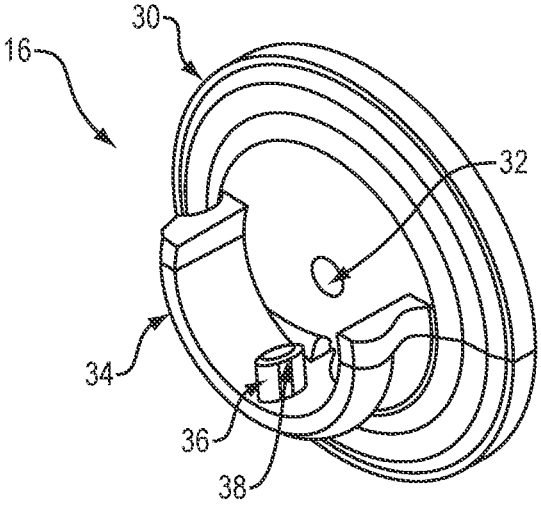
FIG. 3 illustrates a front prospective the cupped bracket with hook.

In FIG. 3, a front prospective of the second cupped bracket with hook 16 is shown and includes base, or back wall, 30 having a central orifice 32. In the embodiment shown, the base 30 is circular. However, in other embodiments, the base 30 may take on different shapes, such as square, rectangular, polygonal, and so forth. Projecting off the base 32 is a semicircular-shaped open cup 34. The cup 34 is designed to receive an end of a curtain rod, such as outside curtain rod tube 14. Positioned within the cup 34 is a peg 36 having a hook 38. As is fully described below, a curtain rod end is releasably engaged by the peg 36 and hook 38.

Figure 4:
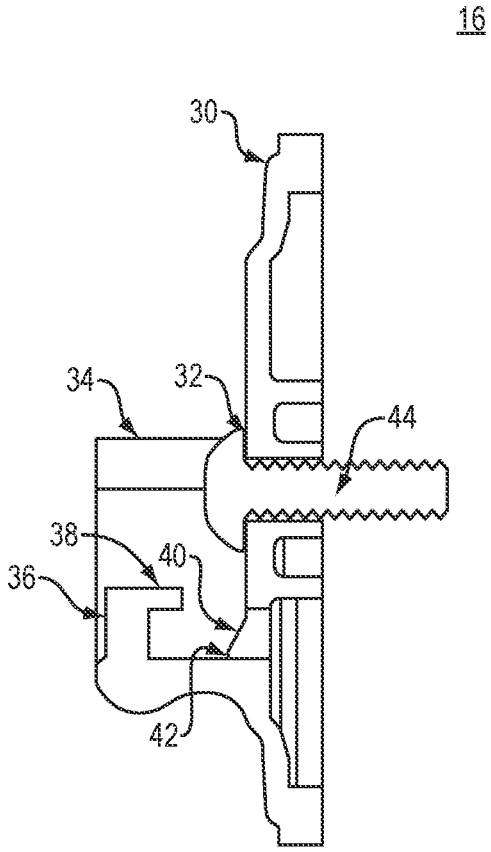
FIG. 4 illustrates a cross-section of the cupped bracket with hook.

As shown in FIG. 4, a cross-section of the second cupped bracket with hook 16 includes the base, or back wall, 30, the cup 34, and the peg 36 having the hook 38. At a point anterior to the peg 36 having the hook 38 and positioned against the base 30 is a ramp 40 have a small vertical flat section at its bottom referred to as a stop 42. As is fully described below, the ramp 40 and stop 42 aid in a placement and retention of a curtain rod end within the cup 34.

In the cross-section shown in FIG. 4, a screw 44 is shown placed in the central orifice 32 to secure the base 30 to a structure such as a wall.

Figure 5:
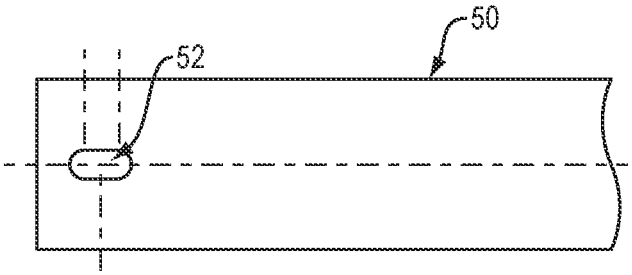
FIG. 5 illustrates an end of a curtain rod.

As shown in FIG. 5, each end of a curtain rod 50 includes a piercing or hole 52. The piercing 52 is provided to engage the peg 36 and the hook 38.

Figure 6:
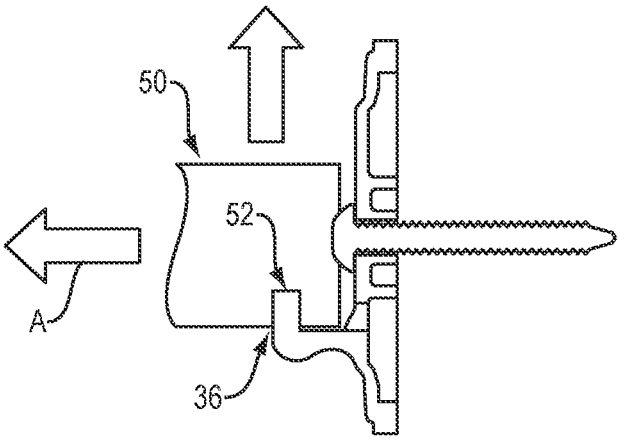
FIGS. 6 and 7 illustrate the peg capture of the end of a tube.
Figure 7:
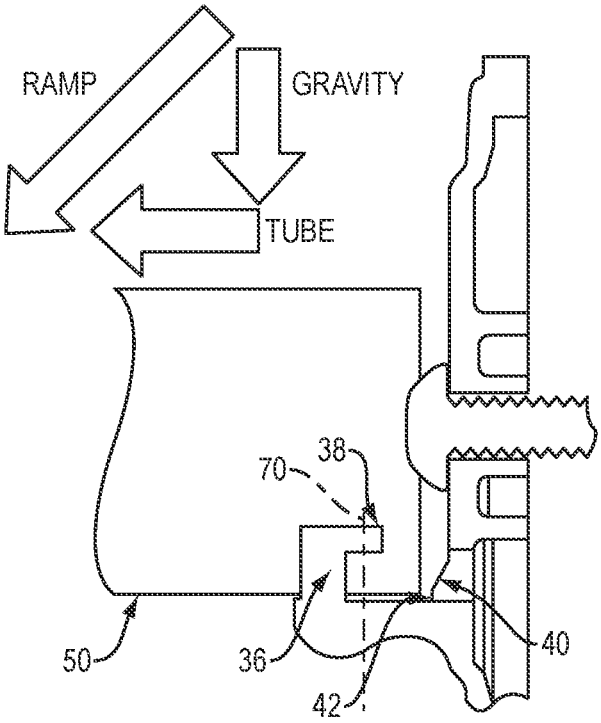

As shown in FIGS. 6 and 7, the peg 36 provides a simple means to capture the end of a tube (i.e., the curtain rod 50. This prevents tubes from freely telescoping as they want to do. Sliding curtains open or closed will cause the tubes to telescope unless there is a means of securing the tubes. The peg 36 prevents tubes from moving axially (see arrow A).

If the curtains hanging from the tubes were pulled and released, the tubes would spring upward, or if the tubes were hit directly, the same or similar action would occur. This could result in the tubes jumping off the pegs 36 and out of the cups 34. This is prevented in part by adding the hook 38 to the peg 36. In most cases any vertical move of the tubes will be restricted by the hook 38 on the peg 36 or by a screw head, which remains proud of the bracket's back wall. To fully secure the tubes to the brackets with hooks, the ramp 40 and stop 42 are added. During installation, the tube will slide down the ramp 40 as the tube piercing 52 engages the peg 36 and hook 38. The action of traveling along the ramp 40 causes the tube to move away from wall. This in turn moves the piercing 52 in the tube under the hook 38, securing the tube from jumping out of the cup 34. The stop 42 prevents the tube from riding back up the ramp 40 while opening curtains or similar actions on the tubes. The tube being forced back against the wall may want to slide up the ramp 40. Having a flat vertical surface for the tube edge to butt against prevents this movement. The vertical line 70 extends the leading edge of piercing 52 showing relation to the hook 38.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A cupped hook bracket comprises:

a back wall having a central aperture;

a cup, the cup having a semi-circular shape and projecting out from the back wall;

a peg extending upwardly from an inner surface of the cup at an approximate center thereof and below the central aperture, and a hook engaging an end of the peg distal the inner cup surface, the hook extending towards the back wall; and a ramp extending from the back wall into the cup and including a flat vertical stop section proximate the inner surface of the cup.

2. The cupped hook bracket of claim 1 wherein the back wall has a circular configuration.

3. The cupped hook bracket of claim 1 wherein the back wall has a rectangular configuration.

4. The cupped hook bracket of claim 1 wherein the back wall has a square configuration.

5. The cupped hook bracket of claim 1 wherein the central aperture is sized to receive a securing device.

6. The cupped hook bracket of claim 5 wherein the securing device is a screw.

7. The cupped hook bracket of claim 1 wherein the hook and the peg are configured to snap into a channel of a rod.

8. An assembly comprising:

a telescoping tube, a first end of the telescoping tube including a channel;

a cupped hooked bracket, the cupped hook bracket configured to engage the channel;

a curtain rod bracket, the curtain rod bracket configured to engage a second end of the telescoping tube, the cupped hooked bracket comprising:

a back wall having a central aperture;

a cup, the cup having a semi-circular shape and projecting out from the back wall;

a peg extending upwardly from an inner surface of the cup at an approximate center thereof and below the central aperture, and a hook engaging an end of the peg distal the inner cup surface, the hook extending towards the back wall; and a ramp extending from the back wall into the cup and including a flat vertical stop section proximate the inner surface of the cup.

9. The assembly of claim 8 wherein the back wall has a circular configuration.

10. The assembly of claim 8 wherein the central aperture is sized to receive a securing device.

11. The cupped hook bracket of claim 10 wherein the securing device is a screw.

* * * * *